US010145327B2

(12) United States Patent
Okazaki et al.

(10) Patent No.: US 10,145,327 B2
(45) Date of Patent: Dec. 4, 2018

(54) DEVICE FOR STOPPING DIESEL ENGINE

(71) Applicant: ISUZU MOTORS LIMITED, Tokyo (JP)

(72) Inventors: Atsushi Okazaki, Fujisawa (JP); Katsushi Shidomi, Fujisawa (JP)

(73) Assignee: ISUZU MOTORS LIMITED, Tokyo (JP)

( * ) Notice: Subject to any disclaimer, the term of this patent is extended or adjusted under 35 U.S.C. 154(b) by 0 days.

(21) Appl. No.: 15/519,795

(22) PCT Filed: Oct. 6, 2015

(86) PCT No.: PCT/JP2015/078359
§ 371 (c)(1),
(2) Date: Apr. 17, 2017

(87) PCT Pub. No.: WO2016/060018
PCT Pub. Date: Apr. 21, 2016

(65) Prior Publication Data

US 2017/0241365 A1 Aug. 24, 2017

(30) Foreign Application Priority Data

Oct. 17, 2014 (JP) ..... 2014-212651

(51) Int. Cl.
*F02D 41/38* (2006.01)
*F02D 41/04* (2006.01)
(Continued)

(52) U.S. Cl.
CPC ..... *F02D 41/3809* (2013.01); *F02D 17/04* (2013.01); *F02D 41/009* (2013.01);
(Continued)

(58) Field of Classification Search
CPC ..... F02D 17/04; F02D 41/04; F02D 41/042; F02D 41/38; F02D 41/3809;
(Continued)

(56) References Cited

U.S. PATENT DOCUMENTS

2002/0157630 A1 10/2002 Gerhard et al.
2003/0101956 A1 6/2003 Sieber
(Continued)

FOREIGN PATENT DOCUMENTS

EP 1403511 A1 3/2004
EP 1457652 A2 9/2004
(Continued)

OTHER PUBLICATIONS

JP 2007-092549 English Translation Version.*
(Continued)

*Primary Examiner* — John Kwon
*Assistant Examiner* — Johnny H Hoang
(74) *Attorney, Agent, or Firm* — Procopio, Cory, Hargreaves & Savitch LLP

(57) ABSTRACT

A device for a common rail diesel engine can control an engine phase when the engine is stopped so the engine can be restarted quickly. An engine phase determining means determines an engine phase based on a crank angle and an angle of a camshaft, an engine stop position determining means stores a stopping time spent from the issuance of an engine stop request to the stop of the engine and obtains an engine phase when the engine is stopped based on the engine phase, resulting when the engine stop is requested, and the stopping time, and an at-time-of-stopping injector control means controls fuel injected from the fuel injectors so the engine phase obtained by the engine stop position determining means when the engine is stopped after making the
(Continued)

engine stop request allows a piston in a specific cylinder to stop at a bottom dead center of a compression stroke.

6 Claims, 5 Drawing Sheets

(51) Int. Cl.
*F04D 17/04* (2006.01)
*F02D 17/04* (2006.01)
*F02D 41/00* (2006.01)
*F02N 19/00* (2010.01)

(52) U.S. Cl.
CPC ..... *F02D 41/042* (2013.01); *F02N 19/005* (2013.01); *F02D 2041/389* (2013.01); *F02N 2019/008* (2013.01)

(58) Field of Classification Search
CPC .. F02D 41/3827; Y02T 10/123; Y02T 10/128; Y02T 10/18; Y02T 10/44
USPC .... 123/179.4, 305, 456, 478, 480, 481, 445, 123/491; 701/102–104, 110–113
See application file for complete search history.

(56) References Cited

U.S. PATENT DOCUMENTS

| | | | | |
|---|---|---|---|---|
| 2003/0163244 | A1 | 8/2003 | Ando et al. | |
| 2006/0047834 | A1 | 3/2006 | Wesinger et al. | |
| 2006/0048734 | A1 | 3/2006 | Kataoka et al. | |
| 2009/0070020 | A1 | 3/2009 | Tetsuno | |
| 2013/0080036 | A1 | 3/2013 | Yamauchi et al. | |
| 2014/0172280 | A1* | 6/2014 | Ogata ..... | G01H 17/00 701/111 |
| 2015/0090218 | A1 | 4/2015 | Nagaoka et al. | |

FOREIGN PATENT DOCUMENTS

| | | | |
|---|---|---|---|
| JP | 2000-045827 | A | 2/2000 |
| JP | 2003-532005 | A | 10/2003 |
| JP | 2003-532006 | A | 10/2003 |
| JP | 2003-314341 | A | 11/2003 |
| JP | 2004-124753 | A | 4/2004 |
| JP | 2004-124754 | A | 4/2004 |
| JP | 2004-263566 | A | 9/2004 |
| JP | 2004-263569 | A | 9/2004 |
| JP | 2004-301078 | A | 10/2004 |
| JP | 2006-057524 | A | 3/2006 |
| JP | 2007-092549 | A | 4/2007 |
| JP | 2008-095655 | A | 4/2008 |
| JP | 2009-062959 | A | 3/2009 |
| JP | 2011-112015 | A | 6/2011 |
| JP | 2013-095154 | A | 5/2013 |
| JP | 2013-204440 | A | 10/2013 |
| WO | 2012/001940 | A1 | 1/2012 |

OTHER PUBLICATIONS

International Search Report and Written Opinion for PCT App No. PCT/JP2015/078359 dated Jan. 12, 2016, 10 pgs.
Extended European Search Report for related European Application No. 15850841.6, dated Jun. 5, 2018; 11 pages.

* cited by examiner

DEVICE FOR STOPPING DIESEL ENGINE

CROSS-REFERENCE TO RELATED APPLICATIONS

This application is a U.S. National Stage entry of PCT Application No. PCT/JP2015/078359, filed on Oct. 6, 2015, which claims priority to Japanese Patent Application No. 2014-212651, filed Oct. 17, 2014, the contents of which are incorporated herein by reference.

TECHNICAL FIELD

The present invention relates to a device for stopping diesel engine for controlling a piston position in a cylinder when the diesel engine is stopped so that the engine can be started quickly when the engine is restarted next time.

BACKGROUND ART

In a common rail diesel engine, by electronically controlling a fuel injector disposed in each of the cylinder, not only an injection timing and injection period of highly pressurized fuel can be controlled accurately but also minute injections such as a pre-injection and a post-injection which are performed before a main injection can be executed.

However, in the event that a piston stop position is unknown when the engine is stopped, unnecessary cranking is generated when the engine is restarted, and this may result in a drawback that the time required to restart the engine becomes long.

PRIOR ART LITERATURE

Patent Literature

Patent Literature 1: JP-A-2004-301078
Patent Literature 2: JP-A-2004-124753
Patent Literature 3: JP-A-2004-124754
Patent Literature 4: JP-T-2003-532005 (the term "JP-T" as used herein means a published Japanese translation of a PCT patent application)
Patent Literature 5: JP-T-2003-532006
Patent Literature 6: JP-A-2003-314341
Patent Literature 7: SP-A-2004-263569

SUMMARY OF THE INVENTION

Problem that the Invention is to Solve

FIG. 5A shows a piston stop position in an arbitrary cylinder in an angular range, for example, of 274° to 292° relative to the rotation of a crankshaft. Then, when the engine is restarted from this stop position, as shown in FIG. 5B, it takes about one second to reach an idling rotation (600 rpm). In this way, in the event that no piston stop control is performed when the engine is stopped, there is caused a problem that the engine cannot be restarted without performing three to four compression strokes.

In Patent Literatures 1 to 5, even in the event that the pistons in each of the cylinders stop in arbitrary positions, the starting performance is enhanced by controlling the timings at which fuel is injected into the cylinders when the engine is started. However, since the control is performed when the engine is started, there is caused a problem that the starting time becomes long.

In Patent Literatures 6, 7, the pistons are slowed down to stop by the motor generator mounted on the hybrid electric vehicle so that the pistons stop in target stop positions. However, this technique cannot be applied to common rail diesel engines.

Then, an object of the present invention is to solve the problems described above to thereby provide a device for stopping a diesel engine for a common rail diesel engine which can control a piston stop position when the engine is stopped so that the engine can be started quickly when the engine is restarted next time.

Means for Solving the Problem

With a view to achieving the object, according to the present invention, there is provided a device for stopping a diesel engine characterized by adjusting minutely fuel which is injected from a fuel injector in synchronism with an engine phase to stop a piston in a specific cylinder at a bottom dead center of a compression stroke when the engine of a common rail diesel engine is stopped.

In addition, according to the present invention there is provided a device for stopping a diesel engine, the device for controlling a piston position in each cylinder to shorten a length of time to start the diesel engine next time when the engine of a common rail diesel engine is stopped, characterized by including a crank angle detecting means for detecting a crank angle of a crank shaft, a camshaft angle detecting means for detecting an angle of a camshaft which opens and closes an intake valve and an exhaust valve, an engine phase determining means for determining an engine phase based on the crank angle sent from the crank angle detecting means and the angle of the camshaft sent from the camshaft angle detecting means, an engine stop position determining means for storing a stopping time spent from an issuance of an engine stop request to stop of the engine and for obtaining an engine phase when the engine is stopped based on the engine phase, which is inputted from the engine phase determining means when the engine stop request is made, and the stopping time, and an at-time-of-stopping injector control means for controlling fuel which is injected from a fuel injector to stop a piston in a specific cylinder at a bottom dead center of a compression stroke after the engine stop request is made based on the engine phase during mopping of the engine obtained by the engine stop position determining means.

The engine phase determining means preferably specifies the cylinder in which the piston is at the bottom dead center where an intake stroke transitions to the compression stroke from the engine phase obtained when the engine stop request is made.

When the engine phase obtained when the engine stop request is made is an engine phase where there exists no cylinder in which the piston is staying at the bottom dead center where the intake stroke transitions to the compression stroke, the engine stop position determining means preferably obtains a deviation amount of a phase of the specific cylinder from the engine stop request to position the piston in the specific cylinder, in the stopping time, at the bottom dead center where the intake stroke transitions to the compression stroke.

The engine stop position determining means preferably changes the deviation amount so that the specific cylinder with the piston which is at the bottom dead center where the intake stroke transitions to the compression stroke in the stopping time is changed sequentially to another cylinder every time the engine stop request is made.

The at-time-of-stopping injector controlling means preferably controls a stopping timing of a fuel injection resulting from the engine stop request by minutely adjusting a fuel injection amount of each of the fuel injector based on the deviation amount of the engine phase of the specific cylinder sent from the engine stop position determining means.

MODE FOR CARRYING OUT THE INVENTION

Hereinafter, a preferred embodiment of the present invention will be described in detail based on the accompanying drawings.

Figure 1:
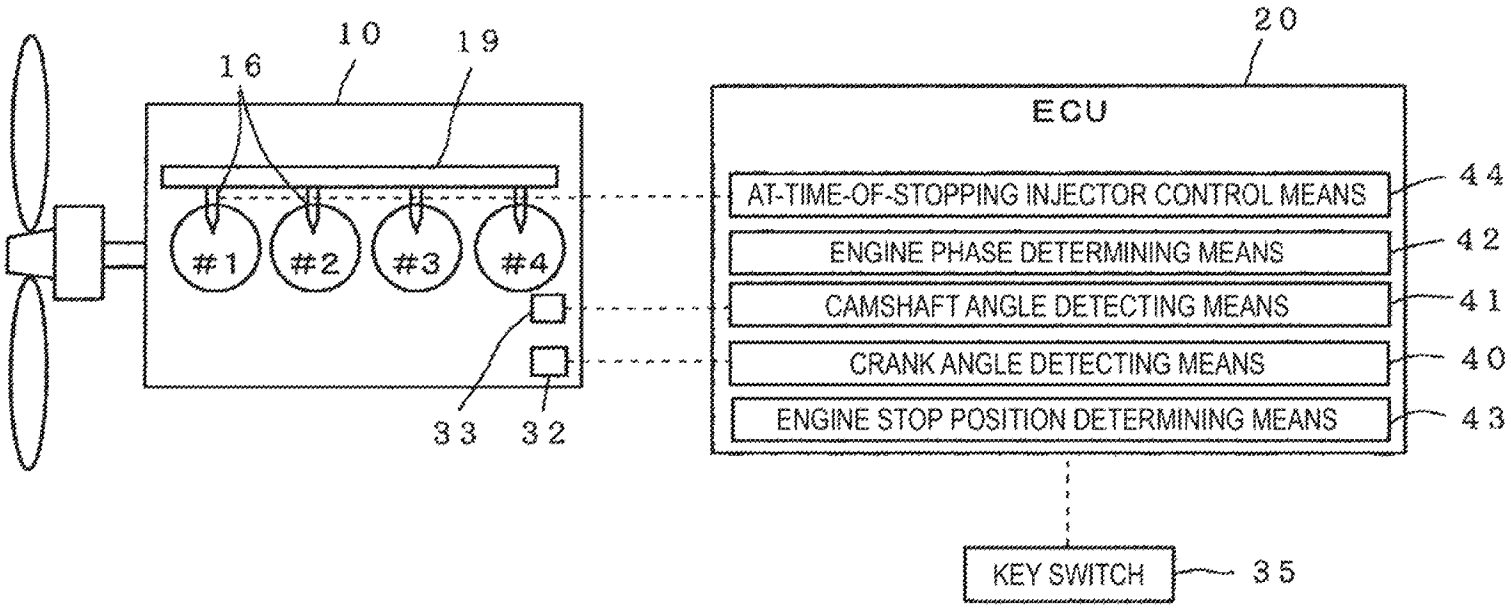
FIG. 1 is a diagram showing an embodiment of a device for stopping a diesel engine of the present invention.
Figure 2:
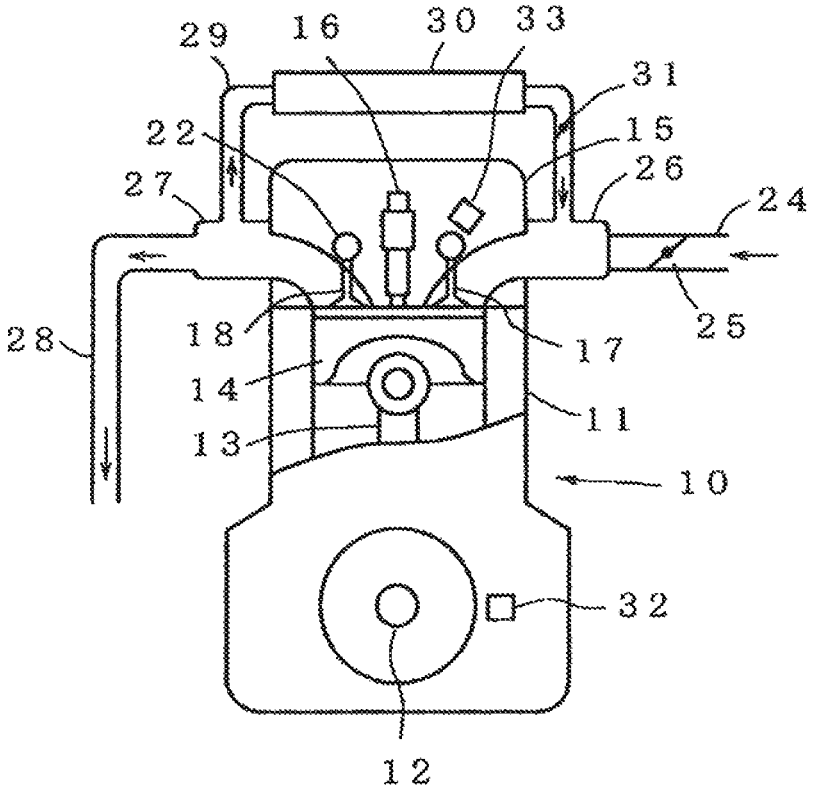
FIG. 2 is a schematic sectional view of the diesel engine shown in FIG. 1.

Firstly, a four-cylinder diesel engine 10 will be described as an example of a common rail diesel engine by using FIGS. 1, 2.

Pistons 14, which reciprocate vertically via a crankshaft 12 and connecting rods 13, are provided individually in cylinders Nos. 1 to 4 in a cylinder block 11 of the diesel engine 10. Fuel injectors 16, which inject fuel into the corresponding cylinders Nos. 1 to 4, intake valves 17 and exhaust valves 18 are provided in a cylinder head 15 resting on the cylinder block 11.

Highly pressurized fuel is supplied to the fuel injectors 16 from a common rail 19, and the fuel injectors 16 are controlled by an ECU 20 so as to be opened and closed, whereby injection timings and injection periods (injection amounts) of fuel into the cylinders Nos. 1 to 4 are controlled.

The intake valves 17 and the exhaust valves 18 are controlled to be opened and closed by valve trains 22 each made up of a rocker arm and a cam.

Intake air which is drawn into the diesel engine 10 is controlled in terms of intake volume from an intake pipe 24 to an intake throttle valve 25 and is then drawn into the cylinders Nos. 1 to 4 by way of an intake manifold 26 and the intake valves 17. Exhaust gases are discharged from the cylinders Nos. 1 to 4 into an exhaust manifold 27 by way of the exhaust valves 18 and is then discharged into an exhaust pipe 28. In addition, exhaust gases are recirculated from part of the exhaust manifold 27 to the intake manifold 26 by way of an EGR pipe 29, an EGR cooler 30 and an EGR valve 31.

A crank angle sensor 32 for detecting a rotational angle of the crankshaft 12 is provided near the crankshaft 12, and a camshaft sensor 33 for detecting a rotational angle of the camshaft is provided near the valve train 22. Detection values of these sensors are inputted into the ECU 20.

A key switch 35 to start and stop the diesel engine 10 is connected to the ECU 20. The ECU 20 starts the diesel engine 10 when the key switch 35 is turned on and stops the fuel injection from the fuel injectors 16 to stop the engine when the key switch 35 is turned off.

The ECU 20 includes a crank angle detecting means 40 into which a detection value of the crank angle sensor 32 is inputted, a camshaft angle detecting means 41 into which detection values of the camshaft sensors 33 are inputted, an engine phase determining means 42 which determines an engine phase based on a crank angle from the crank angle detecting means 40 and the angle of the camshaft from the camshaft angle detecting means 41, an engine stop position determining means 43 which stores a stopping time spent from the issuance of an engine stop request to the stop of the engine and obtains an engine phase when the engine is stopped based on the engine phase, which is inputted from the engine phase determining means 42 when the engine stop request is made, and the stopping time, and an at-time-of stopping injector control means 44 which controls fuel which is injected from the fuel injectors 16 so that the engine phase, during stopping of the engine, obtained by the engine stop position determining means 43 after an engine stop request is made allows the piston in a specific cylinder to stop at a bottom dead center of a compression stroke.

Figure 4:
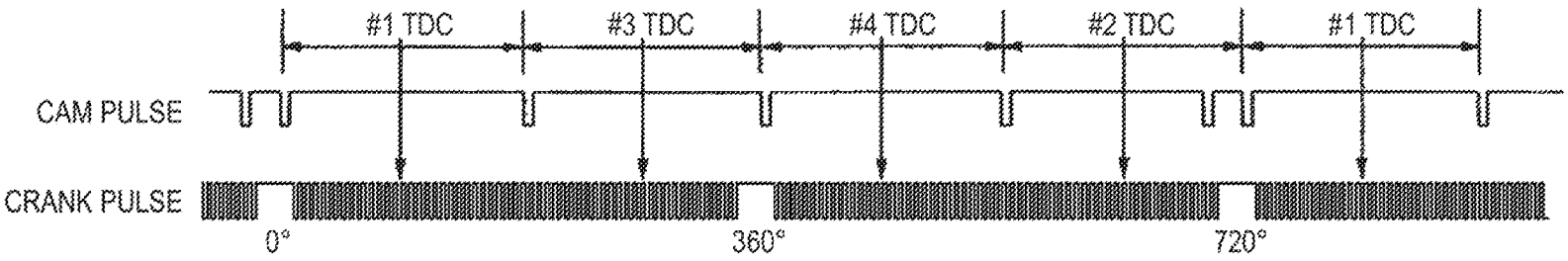
FIG. 4 is a diagram showing a cam pulse of a camshaft sensor and a crank pulse of a crank angle sensor of the device for stopping a diesel engine of the present invention.
Figure 5A:
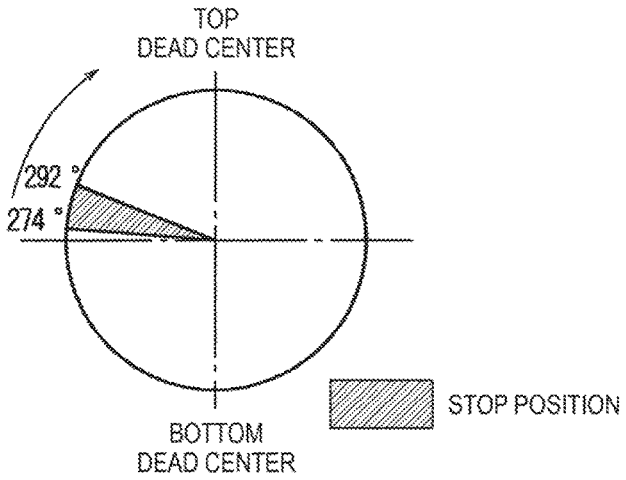
FIG. 5A illustrates an engine stop position in a conventional engine and FIG. 5B illustrates an engine start in the engine stop position shown in FIG. 5A.
Figure 5B:
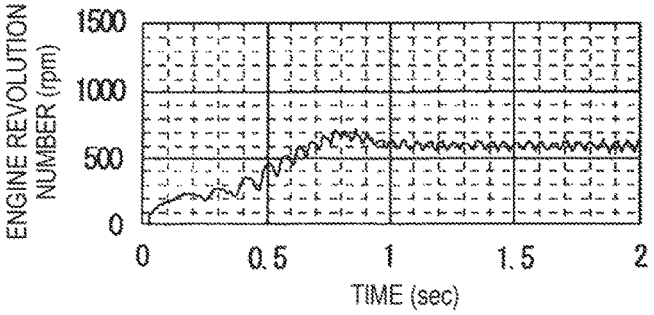

FIG. 4 shows a crank pulse which is inputted from the crank angle sensor 32 to the crank angle detecting means 40, a cam pulse which is inputted from the camshaft sensor 33 to the camshaft angle detecting means 41 and top dead centers (TDCs) of the cylinders Nos. 1 to 4.

The crank angle sensor 32 and the camshaft sensor 33 are each made up of a gear tooth sensor. A crank pulse is outputted by a tooth of a gear provided on the crankshaft, but no crank pulse is outputted by a tooth of the gear when the crankshaft is in an angular position of 0° (360°). In addition, a cam pulse is outputted when a tooth of a gear provided on the camshaft which rotates a half of one rotation thereof when the crankshaft rotates one rotation, and the camshaft rotates one rotation when the crankshaft rotates two rotations (720°). A cam pulse is outputted every time the crankshaft rotates 180°, and two pulses are outputted successively when the crankshaft is in angular positions of 0° and 720°.

The example shown in FIG. 4 indicates that the cylinder No. 1 reaches the top dead center (TDC) at a crank angle of 90°, the cylinder No. 3 reaches the top dead center (TDC) at a crank angle of 270°, the cylinder No. 4 reaches the top dead center (TDC) at a crank angle of 450°, and the cylinder No. 2 reaches the top dead center (TDC) at a crank angle of 630°.

The engine phase determining means 42 can determine an engine phase, that is, positions of the pistons in the cylinders Nos. 1 to 4 based on a crank angle sent from the crank angle detecting means 40 and a camshaft rotation sent from the camshaft angle detecting means 41.

Figure 3A:
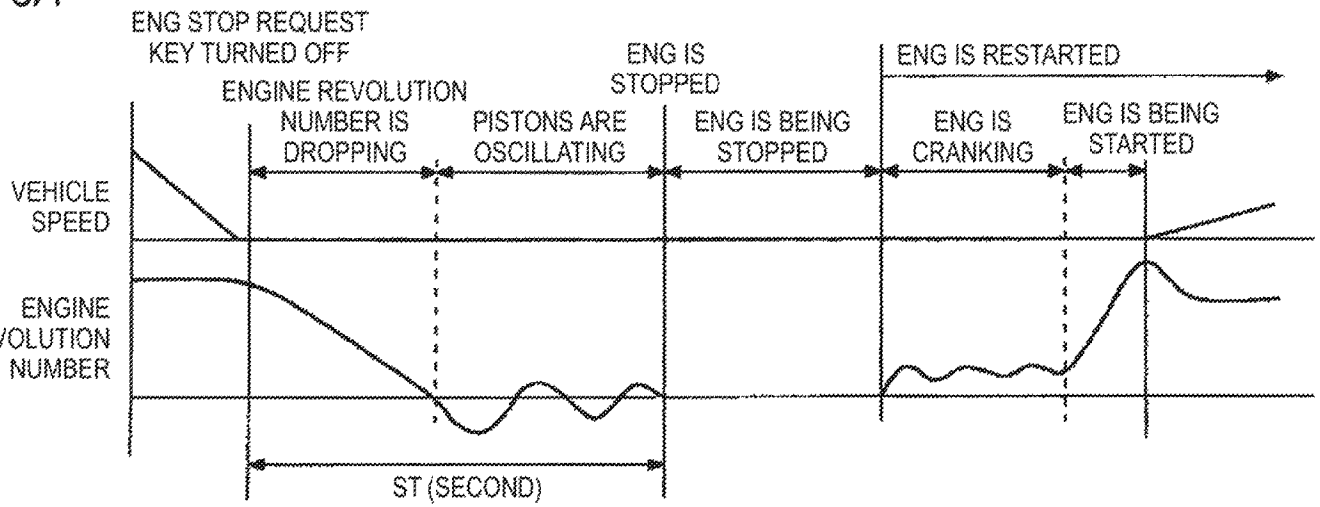
FIGS. 3A and 3B show diagrams showing vehicle speed, engine revolution and piston state in each cylinder when the engine is stopped in the device for stopping a diesel engine of the present invention.
Figure 3B:
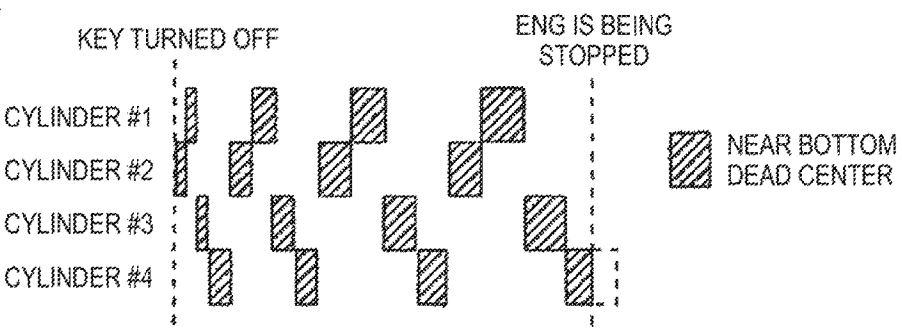

FIG. 3A shows a change in vehicle speed and a change in engine revolution number when the engine is restarted after the vehicle stops running and the engine is stopped as a result of an engine stop request being made. FIG. 3B shows a shift of a bottom dead centers of the piston shift in the cylinders Nos. 1 to 4 until the engine is stopped since the engine stop request is made.

Firstly, as shown in FIG. 3A, in the event that the engine stop request is made by turning off the key switch after the vehicle speed becomes zero and the engine revolution number is lowered to the idling revolution number, the engine revolution number is lowered from the idling revolution number to zero. However, the crankshaft does not stop even if the engine revolution number becomes zero and rotates reversely by means of the returning force of the piston which has been in a compression stroke. Thereafter, a stopping time ST (for example, about 1.5 seconds) elapses during which the motion of a flywheel is balanced against the oscillation of the pistons, whereupon the engine stops. This stopping time ST remains constant on vehicles.

FIG. 3B shows a change in the engine phase, that is, a shift of the cylinders Nos. 1 to 4 where the piston reaches the bottom dead center when the engine stop request is made.

In FIG. 3B, an area shaded with oblique lines indicates an area near the bottom dead center or where the piston is in an angular position 45° towards or away from the bottom dead center. FIG. 3B shows that when the piston in the cylinder No. 2 stays at the bottom dead center, the bottom dead center shifts in the order of the cylinder No. 1, the cylinder No. 3, the cylinder No. 4 and the cylinder No. 2 and that the piston in the cylinder No. 4 stays at the bottom dead center when the stopping time ST elapses whereupon the engine is stopped, when the engine stop request is made.

When the engine is attempted to be restarted after the engine is so stopped, the engine can be restarted in a single compression stroke after cranking is started, thereby making it possible to shorten the restarting time of the engine.

FIG. 3B shows the example in which when the engine stop request is made, the piston in the cylinder No. 2 is staying at the bottom dead center and the piston in the cylinder No. 4 reaches the bottom dead center in the stopping time ST. Then, in the event that the engine stop request is made with the piston in the cylinder No. 1 staying at the bottom dead center, the piston in the cylinder No. 2 reaches the bottom dead center in the stopping time ST. Then, in the event that the engine stop request is made with the piston in the cylinder No. 3 staying at the bottom dead center, the piston in the cylinder No. 1 reaches the bottom dead center in the stopping time ST, and in the event that the engine stop request is made with the piston in the cylinder No. 4 staying at the bottom dead center, the piston in the cylinder No. 3 reaches the bottom dead center in the stopping time ST.

However, the engine phase varies when the engine stop request is made, and no engine stop request is made in the state shown in FIG. 3B. Therefore, it is preferable that the engine phase determining means 42 specifies the cylinder in the cylinders Nos. 1 to 4 in which the piston stays temporarily in the bottom dead center where the intake stroke transitions to the compression stroke from the engine phase obtained when the engine stop request is made. In the event that there exists no cylinder in which the piston stays at the bottom dead center, the engine phase determining means 42 specifies the cylinder in the nearest piston to the bottom dead center, for example, the following cylinder in which the piston is approaching the bottom dead center in the midst of a shift from the intake stroke to the compression stroke and obtains an amount (time) a deviation of the engine phase since the engine stop request is made so that the piston in the specified cylinder reaches the bottom dead center where the intake stroke transitions to the compression stroke in the stopping time ST.

The at-time-stopping injector controlling means 44 controls a fuel injection stopping timing resulting from the engine stop request by minutely adjusting a fuel injection amount of each of the fuel injectors 16 based on the amount of deviation of the engine phase of the specific cylinder sent from the engine stop position determining means 43. Namely, the same state as the state where the engine stop request is made with the piston in the cylinder No. 2 staying at the bottom dead center as described in FIG. 3A by controlling the fuel injection stopping timing by minutely controlling the fuel injection amount of each of the fuel injectors 16, whereby the piston in the cylinder No. 4 can reach the bottom dead center after the stopping time ST elapses.

In the common rail diesel engine, since the amount of fuel injected from the fuel injectors 16 can be controlled highly accurately, the bottom dead center positions in the cylinders Nos. 1 to 4 can be controlled by controlling the fuel injection stopping timing by minutely controlling the amount of fuel injected from the fuel injectors 16 into each of the cylinders Nos. 1 to 4.

As this occurs, in the event that the piston in the cylinder No. 4 is controlled so as to be normally at the bottom dead center when the engine is started, a specific component or components of the engine constituent components deteriorate progressively. In order to protect those engine components, the engine stopping position determining means 43 changes the amount of deviation so that the specific cylinder in which the piston reaches the bottom dead center in the midst of the shift from the intake stroke to the compression stroke is changed to another cylinder of the cylinders Nos. 1 to 4 every time when the engine stop request is made at the stopping time ST and sets the amount of deviation so that the cylinders where the piston stays temporarily at the bottom dead center when the engine is restarted circulate, whereby the durability of the engine constituent components can be enhanced.

What is claimed is:

1. A device for stopping a common rail diesel engine, the device for controlling a piston position in each cylinder to shorten a length of time to start the diesel engine next time when the engine is stopped, the device comprising:

a controller configured to:

detect a crank angle of a crank shaft;

detect an angle of a camshaft which opens and closes an intake valve and an exhaust valve;

determine a first engine phase based on the detected crank angle and the detected angle of the camshaft;

store a stopping time spent from an issuance of an engine stop request to the stop of the engine; and obtain a second engine phase when the engine is stopped based on the first engine phase determined when the engine stop request is made, and the stopping time; and control fuel which is injected from a fuel injector to stop a piston in a specific cylinder at a bottom dead center of a compression stroke after the engine stop request is made based on the obtained second engine phase during stopping of the engine.

2. The device for stopping the common rail diesel engine according to claim 1, wherein the controller specifies the cylinder in which the piston is at the bottom dead center where an intake stroke transitions to the compression stroke from the first engine phase obtained when the engine stop request is made.

3. The device for stopping the common rail diesel engine according to claim 2, wherein the engine includes a plurality of the cylinders including the specific cylinder, and wherein when the second engine phase obtained when the engine stop request is made is an engine phase where there exists no cylinder, in the plurality of the cylinders, in which the piston is staying at the bottom dead center, the controller obtains a deviation amount of a phase of the specific cylinder from the engine stop request to position the piston in the specific cylinder, in the stopping time, at the bottom dead center.

4. The device for stopping the common rail diesel engine according to claim 3, wherein the controller changes the deviation amount so that the specific cylinder with the piston which is at the bottom dead center in the stopping time is changed sequentially to another cylinder every time the engine stop request is made.

5. The device for stopping the common rail diesel engine according to claim 3, wherein the controller controls a stopping timing of a fuel injection resulting from the engine stop request by minutely adjusting a fuel injection amount of each of the fuel injector based on the deviation amount of the obtained second engine phase of the specific cylinder.

6. The device for stopping the common rail diesel engine according to claim 4, wherein the controller controls a stopping timing of a fuel injection resulting from the engine stop request by minutely adjusting a fuel injection amount of each of the fuel injector based on the deviation amount of the obtained second engine phase of the specific cylinder.

* * * * *